US005772098A

United States Patent [19]

Crutcher

[11] Patent Number: 5,772,098

[45] Date of Patent: Jun. 30, 1998

[54] FEED ASSEMBLY FOR A FASTENER DRIVING TOOL

[75] Inventor: John P. Crutcher, Cincinnati, Ohio

[73] Assignee: Senco Products, Inc., Cincinnati, Ohio

[21] Appl. No.: 623,750

[22] Filed: Mar. 29, 1996

[51] Int. Cl.[6] ..... B25C 1/04

[52] U.S. Cl. ..... 227/119; 227/136

[58] Field of Search ..... 227/120, 136, 227/137, 139, 119

[56] References Cited

U.S. PATENT DOCUMENTS

| | | | |
|---|---|---|---|
| 3,524,576 | 8/1970 | Bader | 227/136 |
| 3,708,097 | 1/1973 | Fisher | 227/136 |
| 3,945,551 | 3/1976 | Sato et al. | 227/136 |
| 4,442,965 | 4/1984 | Leistner | 227/136 |
| 4,858,812 | 8/1989 | Fealey . | |
| 4,863,089 | 9/1989 | McCardle et al. | 227/116 |
| 5,240,161 | 8/1993 | Kaneko | 227/136 |
| 5,332,141 | 7/1994 | Mukoyama et al. | 227/136 |

FOREIGN PATENT DOCUMENTS

| | | |
|---|---|---|
| 360573 | 3/1990 | European Pat. Off. . |
| 1239625 | of 1968 | United Kingdom . |

*Primary Examiner*—Scott A. Smith
*Attorney, Agent, or Firm*—Jerrold J. Litzinger

[57] ABSTRACT

A pawl-type assembly for pulling a coiled strip of nails form a canister-type magazine of a nail driving tool and introducing the forwardmost nail of the strip into the drive track of the tool to be driven by the tool driver into a workpiece. The guide body of the tool defines the drive track and has a fixed wall and an openable wall forming there between a passage for the strip of nails from the canister-type magazine to the drive track. The pawl is shiftable by the piston rod of an air cylinder between a rearward position wherein it engages a nail near the forwardmost nail of the strip and a forward position wherein the nearby forwardmost nail of the strip is located in the drive track ready to be driven. The pawl is provided with ledge-like surfaces which, when the pawl is in its forwardmost position, engage the fixed wall of the guide body in such a way as to prevent pawl displacement during the fastener driving portion of the tool cycle.

1 Claim, 5 Drawing Sheets

FEED ASSEMBLY FOR A FASTENER DRIVING TOOL

TECHNICAL FIELD

The invention relates to a feed assembly for a fastener driving tool, and more particularly to a pawl-type feed assembly wherein the pawl is so configured that, when in its forwardmost position, the pawl engages the guide body to prevent pawl displacement during the fastener driving portion of a tool cycle.

BACKGROUND ART

While the teachings of the present invention are applicable to fastener driving tools such as blind rivet tools and the like, they are specifically applicable to nail driving tools wherein the nails are arranged in a tandem row to form a flexible, coilable strip of nails for use in a canister-type magazine. Such an arrangement generally increases the number of fasteners which can be accommodated by the magazine, as compared to the capacity of a typical linear magazine. For these reasons, the invention will be described with respect to a nail driving tool provided with a canister-type magazine adapted to contain a coiled strip of nails.

While there are a number of well known means for holding a tandem row of nails in a coilable strip, one of the most commonly encountered means constitutes a pair of wires tack welded to the shank of each nail.

In a tool of the type to which the invention is directed, a pawl-type feed assembly is used to advance the nails from the canister-type magazine to the drive track of the tool, as is well shown in the art. The drive track of the tool is formed in the tool guide body which also provides a passage for the nails from the magazine to the drive track, as will be explained hereinafter. The guide body is provided with a pawl which is shiftable toward and away from the drive track by an air cylinder actuated piston, to which the pawl is pivotally attached. The pawl engages a nail of the strip other than the forwardmost nail. Usually it engages the second nail of the strip and is shifted by the piston toward the drive track into which the pawl advances the first nail of the strip. After the nail driving portion of the tool cycle has taken place, the pawl is retracted away from the drive track. Means are provided to prevent the strip of nails from moving rearwardly with the pawl. The pawl is pivotally attached to the end of the piston so that it can ride over the nail it previously engaged and can engage the next adjacent nail of the strip. In this fashion, the previously engaged nail now becomes the forwardmost nail of the strip, and the newly engaged nail is the second nail of the strip. The piston then shifts the pawl to its forwardmost position wherein the forwardmost nail of the strip is located in the drive track. This retraction and advancement of the pawl takes place at the end of each tool cycle so that a nail is located in the drive track and the tool is ready for the initiation of the next tool cycle.

When the pawl is in its forwardmost position, parts thereof partially close the opening in the drive track through which the forwardmost nail enters the drive track. It has been found that, under certain circumstances, the lower one of the wires which maintain the nails in strip form can cause displacement of the pawl so that it does not close the drive track during the nail driving portion of the cycle. This can result in "back drive" of the nail, a situation wherein the nail does not pass through or does not properly pass through the bottom portion of the drive track. Not only is the nail improperly driven, but frequently it is bent in the process.

The nail advancing portions of the pawl are slidably mounted in a pair of slots in the guide body, through which the nail advancing parts of the pawl extend. The present invention is based upon the discovery that if the pawl is provided with narrow ledge which engage the inside surface of the guide body at the forward ends of the slots therein, the feed pawl cannot be displaced and this problem is corrected.

DISCLOSURE OF THE INVENTION

According to the invention a nail feed assembly is provided for a nail driving tool having a magazine containing a tandem row of nails joined together by a pair of elongated wires affixed to the shank of each nail, thereby forming a coilable strip of nails. The tool has a guide body with a drive track formed therein to receive a nail to be driven and the driver of the tool. The guide body also has a fixed wall and an openable gate defining therebetween a passage for the strip of nails from the magazine to the drive track. The fixed guide body wall has a pair of upper and lower slots formed therein and supports on its exterior surface a cylinder and piston.

A pawl is provided having body portions which are receivable in and are slidable in the slots of the guide body and which terminate in nail engaging lugs which normally extend into the guide body passage. The pawl is pivotally mounted on the piston and is swingable thereon between a first position wherein the pawl lugs are within the guide body passage and a second position wherein the pawl lugs are substantially withdrawn from the guide body passage. The pawl is biased to its first position by a torsion spring.

At the end of each nail driving portion of a tool cycle, the pawl is shifted by the piston in a direction away from the drive track. During this rearward shift, the pawl pivots on the piston, against the action of the torsion spring, to override the nail it was engaging and to engage the next adjacent nail. At this point, the piston shoves the pawl forwardly toward the drive track, causing the nail strip to be advanced and the nail previously engaged by the pawl (now the forwardmost nail) to be located in the drive track. When in its forwardmost position, narrow ledges formed on the pawl engage the inside surface of the guide body fixed wall at the ends of the slots formed therein. This engagement of the inside surface of the guide body fixed wall and the attachment of the pawl to the piston preclude displacement of the pawl during the nail driving portion of the tool cycle.

DETAILED DESCRIPTION OF THE INVENTION

Figure 1:
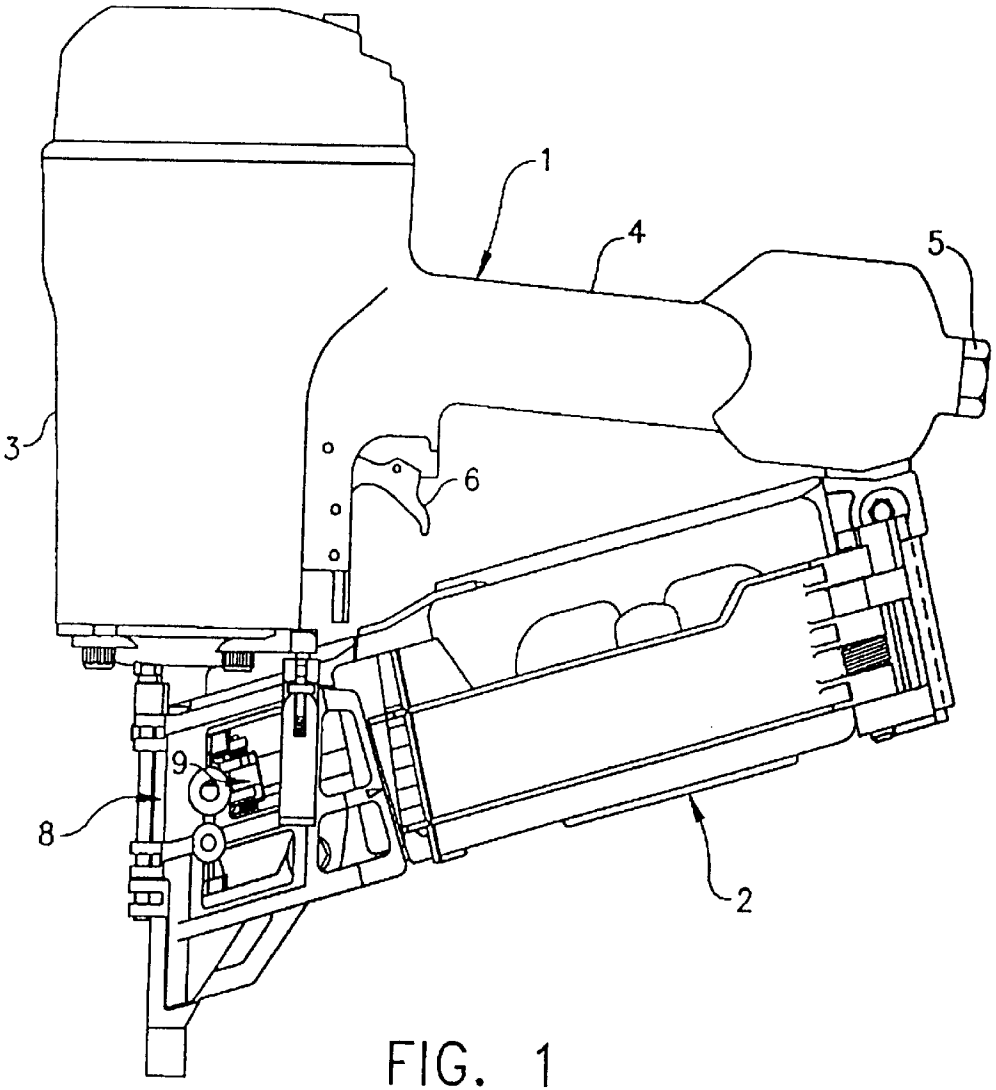
FIG. 1 is a side elevational view of an exemplary tool provided with a cannister-type magazine and a fastener feed assembly of the present invention.

Throughout the specification like parts have been given like index numerals. Reference is first made to FIG. 1 which illustrates an exemplary nail driving tool, generally indicated at 1, provided with the feed assembly of the present invention. The tool 1 has a canister-type magazine generally indicated at 2. The tool 1 has a main body portion 3 and a body portion 4 constituting a handle for the tool.

As is well known in the art, the main body portion 3 of tool 1 contains a cylinder (not shown) having a piston/driver assembly (not shown) therein. A part of the main body portion 3 and the handle portion 4 constitute a reservoir for air under pressure. The air under pressure is introduced into the reservoir by a hose (not shown) connected to a source of compressed air (not shown). The hose is attached to the fitting 5 of handle 4. The piston/driver assembly of the tool cylinder is actuated to drive a fastener by means of a normally closed main valve (not shown) at the top of the cylinder. The valve may be opened (permitting high pressure air to actuate the piston/driver assembly to drive a fastener) by means of a remote valve (not shown) which is actuated by the tool trigger 6.

Beneath the main body portion 3 of the tool, there is a guide body, generally indicated at 8. The guide body 8 contains a drive track (not shown in FIG. 1) to accommodate a fastener to be driven and a lower end of the piston/driver assembly. The tool 1 is provided with a feed assembly, generally indicated at 9, and to be described in detail hereinafter.

Figure 2:
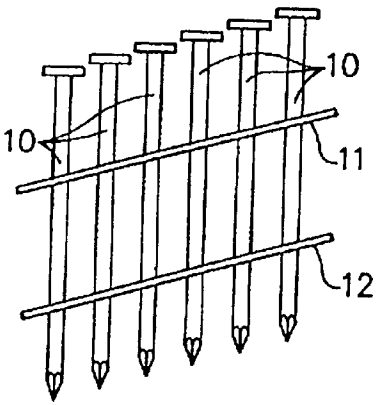
FIG. 2 is a fragmentary elevational view of an exemplary coilable nail strip.

FIG. 2 is a fragmentary elevational view illustrating a plurality of nails 10, arranged in a tandem row and joined together to form a strip of such nature that it can be coiled and used in the canister-type magazine 2. A pair of frangible wires 11 and 12 are welded to the shank of each nail 10, thus forming the nails 10 into an elongated, coilable strip.

Figure 3:
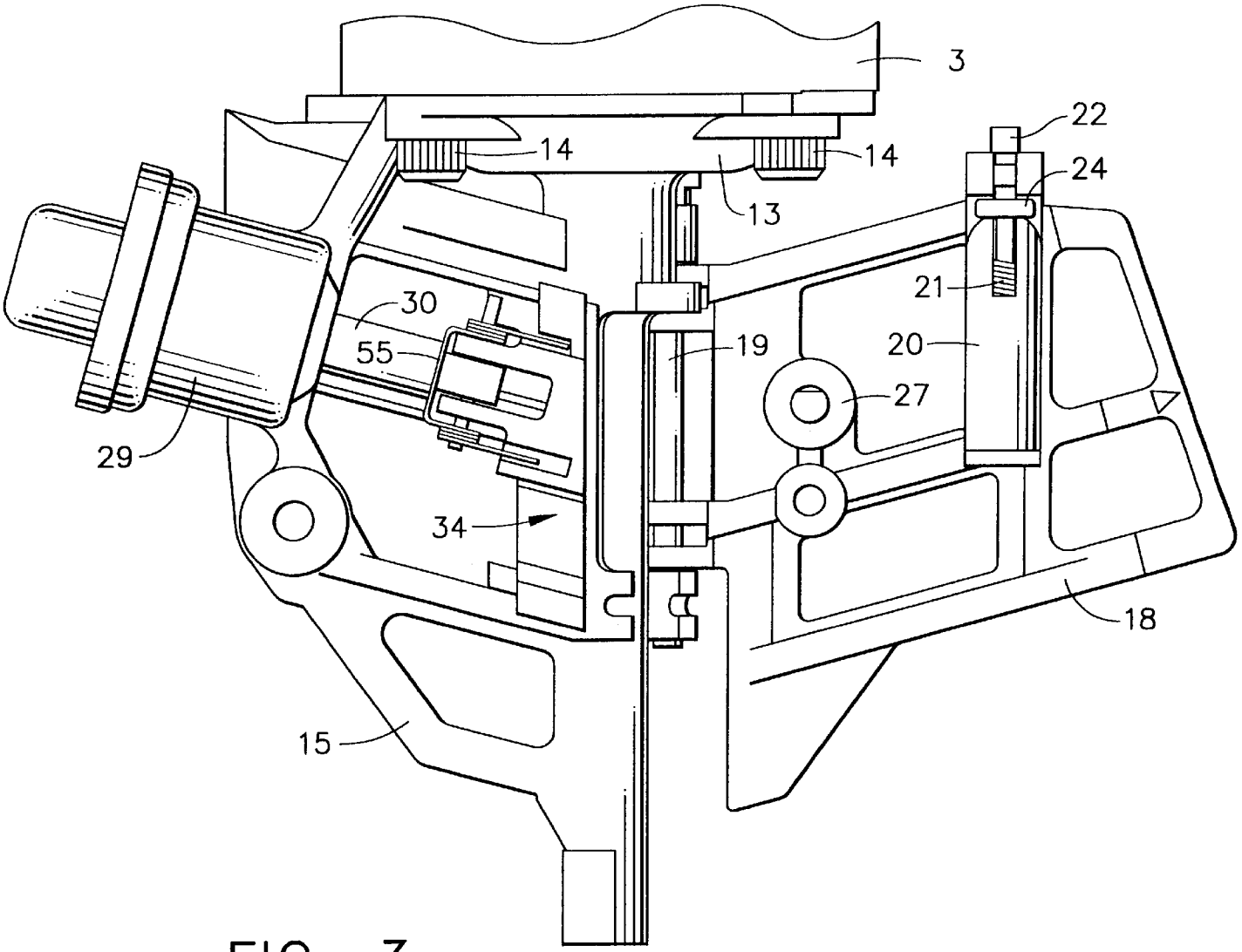
FIG. 3 is a fragmentary right side elevational view of the guide body with its gate open.
Figure 4:
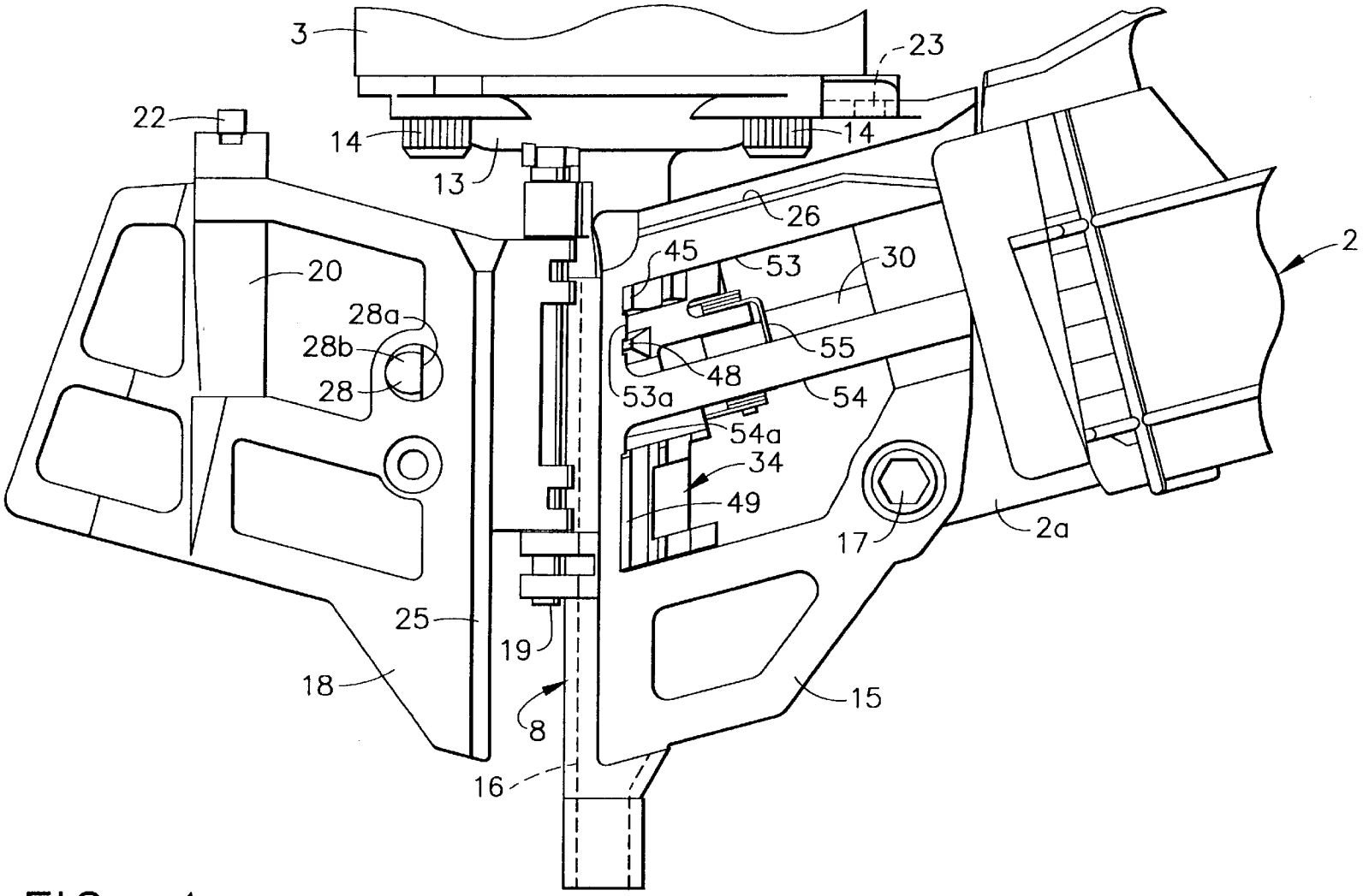
FIG. 4 is a fragmentary left side elevational view of the guide body with its gate open.

Reference is now made to FIGS. 3 and 4. The guide body 8 has an upper plate-like portion 13 which is affixed to the bottom of the main body portion 3 of tool 1 by a series of machine screws 14. The guide body 8 has a fixed wall 15, the forward edge of which defines a part of the drive track 16. Fixed wall 15 supports the feed assembly 9. The forward end of the canister-type magazine 2 has an extension 2*a* by which it is attached to guide body wall 15 by a bolt 17.

A gate or openable wall 18 is hingedly attached to the forward end of fixed wall 15 by hinge pin 19. The gate 18 of guide body 8 is swingable from an open position shown in FIGS. 3 and 4 to a closed position shown in FIG. 1. Gate 18 has on its exterior surface a cylindrical member 20 which comprises a latch body containing a compression spring 21 and a latch bolt 22. The bolt 22 is constantly urged to its extended position shown in FIGS. 3 and 4. The bolt 22 is adapted to be received in a perforation 23 (see FIG. 4) in the plate-like member 13 of the guide body. The bolt 22 has a manually actuated release member 24 by which the bolt may be manually withdrawn from perforation 23, unlocking the gate and enabling the gate to be opened. It will be noted that the gate 18 has near its hinged end a portion 25 which forms an additional part of the drive track 16.

When the gate 18 is in its closed and latched position, as shown in FIG. 1, the gate 18 and the fixed wall 15 form therebetween a passageway extending between the canister-type magazine 2 and the drive track 16. The fixed wall 15 has a ledge 26 which serves as a guide for heads of the nails of the nail strip.

Finally, the gate 18 has integrally formed thereon a cylindrical portion 27 (see FIG. 3) which contains a spring loaded detent 28 (see FIG. 4). Detent 28 has an abutment surface 28*a* and a camming surface 28*b*. The detent 28 is biased by its compression spring (not shown) to its extended position wherein the surfaces 28*a* and 28*b* are located within the passage formed between gate 18 and fixed wall 15. Detent 28 may be shifted to a retracted position, against the action of its compression spring, wherein the detent surfaces 28*a* and 28*b* are substantially removed from the guide body passage. The purpose of detent 28 will be apparent hereinafter.

Turning again to FIGS. 3 and 4, and particularly to FIG. 3, it will be noted that the fixed wall 15 of guide body 8 supports a cylinder 29 containing a piston (not shown) and a piston rod 30. The cylinder is an air actuated cylinder. When pressurized air is introduced into the cylinder, the piston causes the piston rod to shift toward the cylinder. When the cylinder is unactuated, a spring therewithin urges the piston rod in a direction away from the cylinder.

Figure 7:
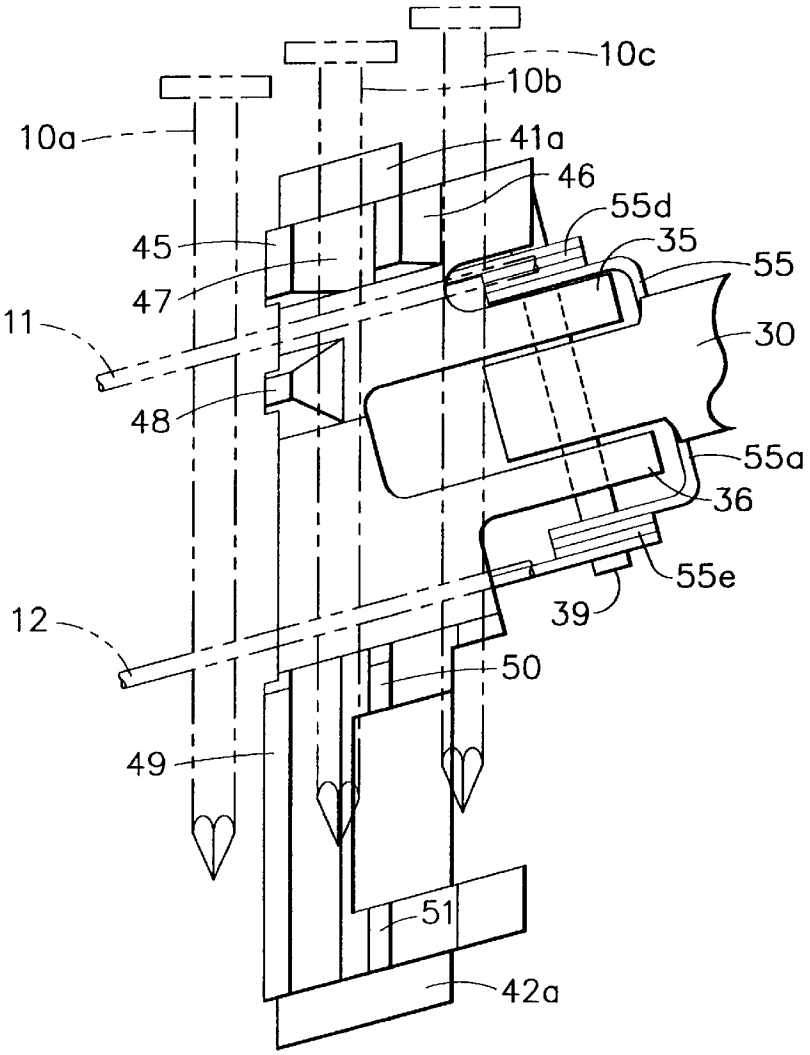
FIGS. 6 and 7 are respectively a fragmentary left side elevational view and a fragmentary right side elevational view of the pawl and piston of the present invention.

Reference is now made to FIGS. 3 and 7. It will be noted that the forwardmost end of piston rod 30 is provided with diametrically opposed, parallel flats 31 and 32. At the position of the flats 31 and 32, the forwardmost end of piston rod 30 is provided with a transverse bore 33. The feed pawl, generally indicated at 34, is provided with a pair of bifurcations 35 and 36 having coaxial bores 37 and 38 therethrough. The feed pawl 34 is rotatively attached to the end of piston rod 30 by a pivot pin 39 which passes through bifurcation perforations 37 and 38 and piston rod perforation 33.

Figure 5:
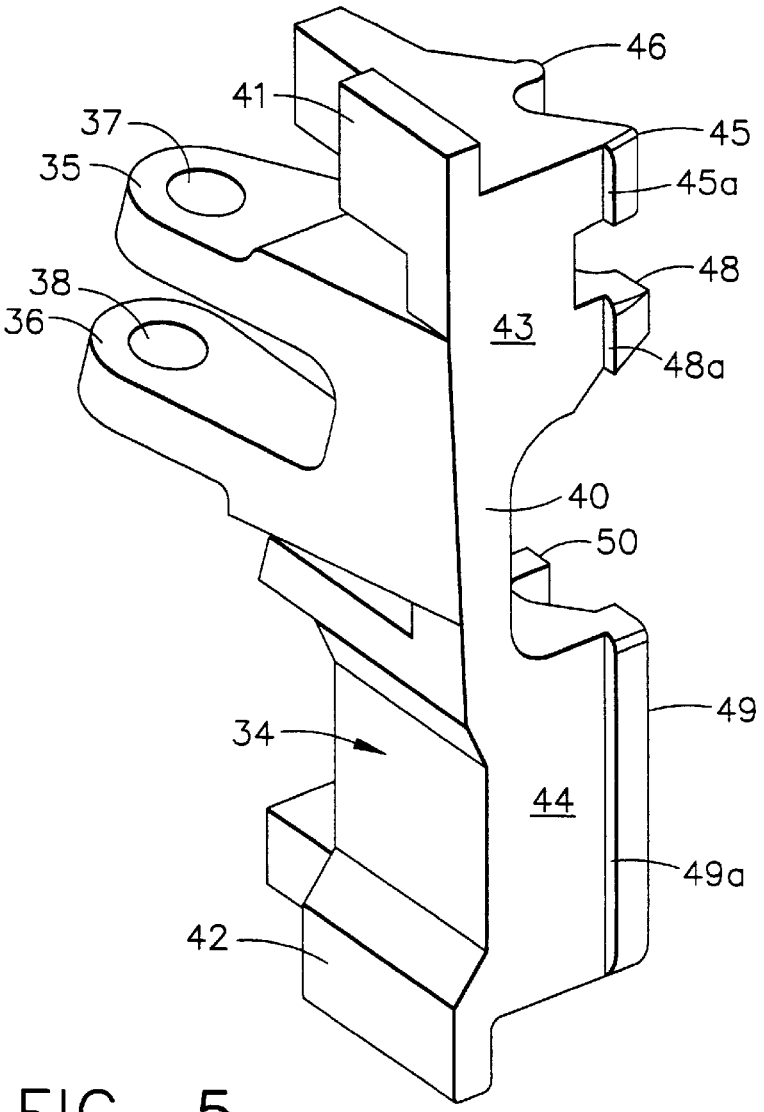
FIG. 5 is a perspective view of the pawl of the present invention.
Figure 6:
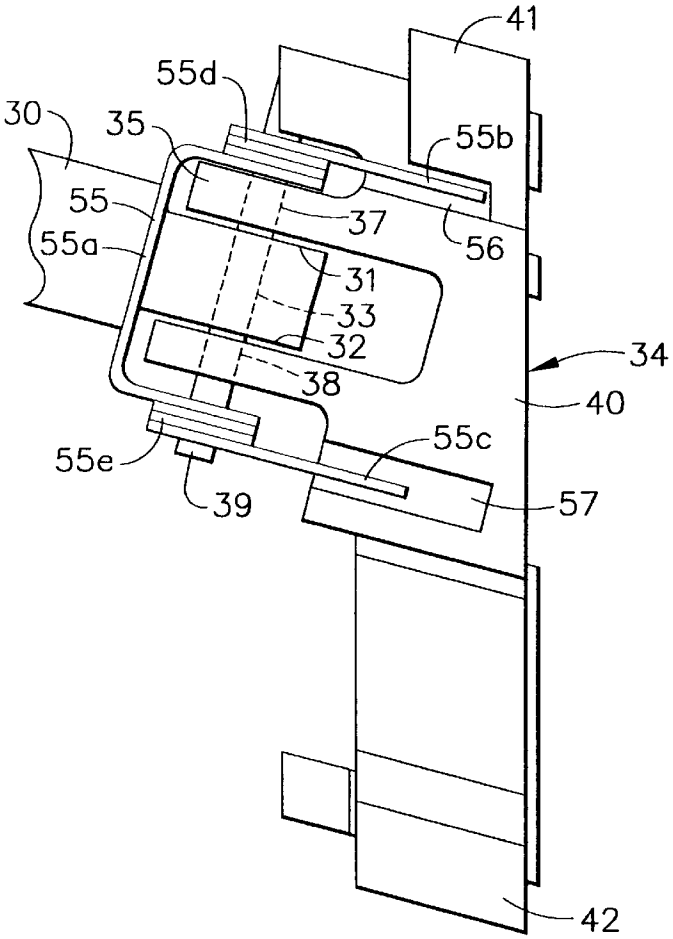

Reference is now made to FIGS. 5, 6 and 7. The feed pawl 34 has an main body portion 40 from which the bifurcations 35 and 36 extend. At its upper end the main body portion 40 has a flange 41. At its lower end, the main body portion has a flange 42. As is most clearly shown in FIG. 7, the flange 41 has a surface 41*a* and the flange 42 has a surface 42*a*, the purpose of which will be apparent hereinafter.

As is most clearly shown in FIG. 5, the main body portion 40 of feed pawl 34 has an upper extension 43 and a lower extension 44. The upper extension 43 has a pair of lugs 45 and 46 formed thereon with a substantially U-shaped notch 47 formed therebetween. Upper extension 43 also has a third lug 48 similar to lug 45. The lower extension 44 has an elongated lug 49 formed thereon together with a pair of lugs 50 and 51 facing lug 49 and forming therebetween a substantially U-shaped notch 52.

Returning for a moment to FIGS. 3 and 4, it will be noted that the fixed guide body wall 15 has an upper slot 53 and a lower slot 54 formed therein. The slots 53 and 54 extend in a direction running between the canister-type magazine 2 and the drive track 16. The slots 53 and 54 terminate near the drive track 16 in ends 53*a* and 54*a*, respectively. It will be evident from FIGS. 3, 4 and 5 that the upper extension 43 of feed pawl 34 is sized to be received within and to be slidable longitudinally within guide body slot 53. Similarly, feed pawl extension 44 is sized to fit within and to slide longitudinally within guide body slot 54. When the feed pawl extension 43 and 44 are fully within slots 53 and 54 respectively, their lugs 45, 46, 48, 49, 50 and 51 and the nail receiving grooves 47 and 52 are located within the passage formed by the fixed wall 15 and the gate 18 of guide body 8. The depth to which the extensions 43 and 44 of feeder pawl 34 enter into slots 53 and 54, respectively, is determined by abutment of the face 41*a* of extension 41 and the face 42*a* of extension 42 of the feed pawl against the outside surface of the fixed wall 15 adjacent the upper edge of slot 53 and the lower edge of slot 54, respectively.

Even though feed pawl 34 is pivotable about pivot pin 39 at the end of piston rod 30, the surfaces 41*a* and 42*a* are normally held in slidable abutment against fixed guide body wall 15 by a torsion spring. Torsion spring 55 is generally U shaped and has a crown portion 55*a* which abuts piston rod 30. The legs 55*b* and 55*c* of torsion spring 55 abut exterior surfaces 56 and 57 of feed pawl 34. Each of the legs 55*b* and 55*c* have coiled portions 55*d* and 55*e* which wrap about pivot pin 39.

Figure 8:
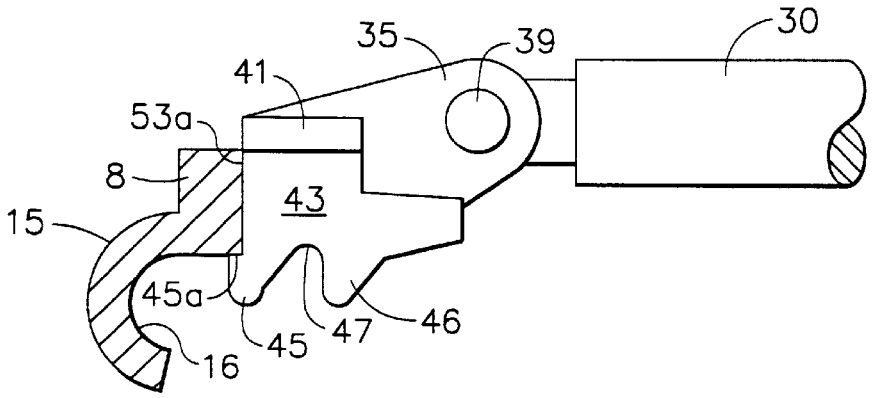
FIG. 8 is a fragmentary, simplified, plan view, partly in cross section, and illustrating the engagement of the guide body by one of the feed pawl ledges.

Reference is made to FIGS. 4, 5 and 8. Turning first to FIG. 5, it will be noted that the forwardmost lugs 45, 48 and 49 of feed pawl 34 are configured to provide the narrow ledges 45*a*, 48*a* and 49*a*, respectively. As is clearly shown in FIGS. 4 and 8, when the feed pawl 34 is in its forwardmost position, the ledges 45*a* and 48*a* engage the inside surface of fixed guide body wall 15 at the forward end of slot 53. Similarly, the ledge 49*a* of lug 49 engages the adjacent inside surface of guide body fixed wall 15 at the forwardmost end of slot 54.

The invention having been described in detail, and the manner in which it functions may now be set forth.

When the nail driving tool is ready to be actuated, the forwardmost nail of the strip thereof is located in the drive track 16. The second nail of the strip is engaged by the feeder pawl 34, the shank of the nail being received within the groove 47 between lugs 45 and 46, and in the groove 52 formed between lug 49 and lugs 50 and 51. The first three nails of the strip are illustrated in broken lines in FIG. 7. The forwardmost nail 10*a* is to be considered as being in the drive track. The second nail 10*b* is engaged by the feeder pawl, and the third nail is shown at 10*c*. Once the nail driving portion of a tool cycle has been completed, the cylinder 29 is actuated and the piston rod pulls the feeder pawl 34 in a direction away from drive track 16. The lugs 45, 48, and 49 are so configured as to cam the feeder pawl over the nail 10*b*. At the same time, lugs 46, 50 and 51 are so configured as to can the feeder pawl 34 over the nail 10*c*. At the rearwardmost position of the pawl 34, the nail 10*c* will be received within the feeder pawl slots 47 and 52. This is true because the torsion spring 55 will return the feeder pawl 34 to a condition wherein its surfaces of 41*a* and 42*a* are again in slidable abutment with the outside surface of fixed guide body wall 15.

The detent 28 (see FIG. 4) is so positioned on gate 18 that when the gate 18 is in its closed position, the flat abutment surface 28*a* of detent 28 lies adjacent the nail 10*c*. Abutment of detent surface 28*a* against nail 10*c* assures that the nail strip is not dragged rearwardly by the rearward movement of the feeder pawl 34.

After nail 10*a* has been driven by the tool driver, nail 10*b* becomes the forwardmost nail of the strip. In similar fashion, nail 10*c* becomes the second nail of the strip. With the feeder pawl 34 in its rearwardmost position (by virtue of the rearward movement of piston rod 30), the feeder pawl now once again engages the second nail of the strip. At this point, compressed air within cylinder 29 is discharged to atmosphere and the compression spring (not shown) within the cylinder returns the piston and feeder pawl 34 to their forwardmost positions. This results in an advancement of the nail strip so that the now forwardmost nail 10*b* of the strip is located by the feeder pawl in drive track 16. At the same time, the ledges 45*a*, 48*a* and 49*a* engage the inside surface of the fixed wall of the guide body at the ends of slots 53 and 54. The feeder pawl is now firmly held in place along its forward edge by ledges 45*a*, 48*a* and 49*a* and is firmly held in place along its rearward edge by piston rod 30. As a result, the feeder pawl cannot be displaced from is proper position wherein lugs 45, 48 and 49 partially close the drive track 16 before and during driving of the forwardmost nail by the tool driver. When the feeder pawl achieves its forwardmost position, the tool is ready to actuate, initiating another tool cycle. Once the forwardmost nail is driven by the tool driver into a workpiece, the feeder pawl is drawn rearwardly and then shifted forwardly by the piston rod, as just described, to place the tool in condition for initiation of another cycle.

Modifications may be made in the invention without departing from the spirit of it, so long as the feed pawl is locked as described when in its forwardmost position.

What is claimed:

1. A pawl-type nail feed assembly for a nail driving tool of the type having a coiled strip of nails, a canister-type magazine for said coiled nails and a guide body having a drive track formed therein together with a fixed wall and a gate forming a passage between said magazine and said drive track for said nails, said nail feed assembly comprising an air cylinder with a piston rod, a feed pawl pivotally attached to said piston rod, said pawl being shiftable by said piston rod between a rearward piston wherein said pawl engages a nail of said strip other than the forwardmost nail thereof and a forward position wherein said forwardmost nail of said strip is located in said drive track, ledgelike surfaces on said pawl, said ledgelike surfaces engaging said fixed wall of said guide body, when said pawl is in said forwardmost position, whereby displacement of said pawl is precluded during the nail driving part of the cycle of said tool.

* * * * *